US008603260B2

(12) United States Patent
Classen et al.

(10) Patent No.: US 8,603,260 B2
(45) Date of Patent: Dec. 10, 2013

(54) DISHWASHER COMPRISING A HEAT TUBE

(75) Inventors: Egbert Classen, Stahnsdorf (DE); Helmut Jerg, Giengen (DE); Kai Paintner, Welden (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/452,970

(22) Filed: Apr. 23, 2012

(65) Prior Publication Data

US 2012/0204911 A1 Aug. 16, 2012

Related U.S. Application Data

(63) Continuation of application No. 10/564,433, filed as application No. PCT/EP2004/007392 on Jul. 6, 2004, now abandoned.

(30) Foreign Application Priority Data

Jul. 30, 2003 (DE) ..... 103 34 793

(51) Int. Cl.
*B08B 3/00* (2006.01)

(52) U.S. Cl.
USPC ..... 134/56 D; 134/115 R; 134/18; 134/107; 165/10; 165/104.21; 165/157

(58) Field of Classification Search
USPC ..... 68/3 R, 20; 134/94.1, 102.3, 105, 115 R, 134/18, 56 D, 107, 95.2; 165/10, 104.21, 165/157
See application file for complete search history.

(56) References Cited

U.S. PATENT DOCUMENTS

| | | | | |
|---|---|---|---|---|
| 2,350,348 | A | 6/1944 | Gaugler | |
| 3,068,877 | A | 12/1962 | Jacobs | |
| 3,658,075 | A | 4/1972 | Jacobs | |
| 3,865,184 | A * | 2/1975 | Grover | 165/104.26 |
| 3,985,182 | A | 10/1976 | Hara et al. | |
| 4,103,433 | A | 8/1978 | Taylor | |
| 4,147,135 | A | 4/1979 | Herbst | |

(Continued)

FOREIGN PATENT DOCUMENTS

| | | | |
|---|---|---|---|
| DE | 2716686 A1 | 10/1978 | |
| DE | 29 14 859 * | 10/1980 | D06F 58/00 |

(Continued)

OTHER PUBLICATIONS

International Search Report PCT/EP2004/007392.

(Continued)

*Primary Examiner* — Michael Barr
*Assistant Examiner* — Thomas Bucci
(74) *Attorney, Agent, or Firm* — James E. Howard; Andre Pallapies

(57) ABSTRACT

A dishwasher is provided that allows the dishes that are to be cleaned that have been placed in a cleaning container to be washed and dried efficiently from an economic perspective while keeping the energy consumption associated therewith as low as possible. The dishwasher includes a washing container and a conduit system that is connected in an air-conveying manner to the washing container. A heat tube of the conduit system is used for both cooling, and thus drying, and heating air penetrating the washing container and both ends of the heat tube protrude into the washing container.

18 Claims, 4 Drawing Sheets

(56) References Cited

U.S. PATENT DOCUMENTS

| | | | | |
|---|---|---|---|---|
| 4,440,215 | A | 4/1984 | Grover et al. | |
| 4,603,489 | A | 8/1986 | Goldberg | |
| 5,076,306 | A | 12/1991 | Suzuki et al. | |
| 5,159,972 | A | 11/1992 | Gunnerson et al. | |
| 5,189,884 | A | 3/1993 | Sami | |
| 5,343,632 | A * | 9/1994 | Dinh | 34/507 |
| 5,361,511 | A | 11/1994 | Brown | |
| 5,732,562 | A * | 3/1998 | Moratalla | 62/94 |
| 6,644,059 | B2 | 11/2003 | Maeda et al. | |
| 2003/0140517 | A1 | 7/2003 | Schmid | |

FOREIGN PATENT DOCUMENTS

| | | | | |
|---|---|---|---|---|
| DE | 2914859 | A1 | 10/1980 | |
| DE | 3038080 | A1 | 5/1982 | |
| DE | 31 34 506 | * | 3/1983 | D08F 58/00 |
| DE | 3134506 | A1 | 3/1983 | |
| DE | 3741652 | A1 | 6/1989 | |
| DE | 4307372 | A1 | 9/1994 | |
| DE | 20101641 | U1 | 6/2002 | |
| EP | 0358279 | A1 | 3/1990 | |
| FR | 2 491 322 | * | 4/1982 | A47L 15/48 |
| FR | 2491322 | A1 | 4/1982 | |
| GB | 2 059 035 | * | 4/1981 | F26B 11/02 |
| GB | 2059035 | A | 4/1981 | |
| JP | 6133915 | A | 5/1994 | |
| JP | 08196796 | A | 8/1996 | |

OTHER PUBLICATIONS

National Search Report DE 103 34 793.3.

* cited by examiner

DISHWASHER COMPRISING A HEAT TUBE

CROSS-REFERENCE TO RELATED APPLICATIONS

This application is a continuation, under 35 U.S.C. §120, of U.S. application Ser. No. 10/564,433, filed Jan. 10, 2006, which is a U.S. national stage application under 35 U.S.C. §371 of PCT/EP2004/007392, filed Jul. 6, 2004, which designated the United States; this application also claims the priority, under 35 U.S.C. §119, to German Application No. 103 34 793.3, filed Jul. 30, 2003.

BACKGROUND OF THE INVENTION

The invention relates to a dishwasher comprising a cleaning container.

It is known that a dishwasher has a washing method whose programme run consists of at least one partial programme step "pre-wash", a partial programme step "clean", at least one partial programme step "intermediate rinse", a partial programme step "clear rinse" and a partial program step "dry". To increase the cleaning effect, the sing liquid is heated before or during a partial programme step. The rinsing liquid is usually heated by means of electrical heaters. Various drying systems are known for drying objects to be washed in a dishwasher.

For example, the objects to be washed can be dried by own-heat drying if the rinsing liquid is heated in a partial programme step "clear rinse" and thus the objects to be washed which have undergone a hot clear rinse are dried by themselves by the self-heat of the objects to be washed which has thus built up during the drying process. In order to achieve this own-heat drying, the rinsing liquid is heated to a certain temperature in a heat exchanger in the "clear rinse" partial programme step and applied to the objects to be washed by means of spraying devices. As a result of the relatively high temperature of the rinsing liquid in the "clear rinse" partial programme step of usually 65° C. to 75° C., a sufficiently large quantity of heat is transferred to the objects to be washed so that water adhering to said objects to be washed vaporises as a result of the heat stored in the objects to the washed.

In a further known drying device, a separate heat source, e.g. a hot air fan, is used to heat the moist air mixture during the drying process so that the air in the washing container can absorb a larger quantity of moisture.

Dishwashers are known in which the moist air is vented outwards. This is disadvantageous since the surrounding kitchen furniture is damaged.

Thus, other dishwashers are known in which the moist air is passed over condensing surfaces on which the moisture condenses before being guided out. This condensation is either passed into the washing container or into special collecting containers.

A dishwasher is known from DE 27 16 686 A1 wherein a heat tube protrudes in the washing container and forms a cooling surface there. The heat given off by the hot moist air is transported outwards by means of the heat tube. In order that the heat tube does not also remove heat during the partial programme steps in which heating is desired in the washing container, in these partial programme steps the heat tube is filled with an inert gas which prevents the heat tube from functioning.

A disadvantage in the heating systems described above is that heating of the rinsing liquid is associated with a high energy requirement and the thermal energy required for each heating phase must be produced anew by means of electrical heating elements. The known heating systems also have the disadvantage that heating of the rinsing liquid in the "clear rinse" partial programme step and the processes in the "drying" partial programme step are themselves associated with a high energy requirement and the thermal energy required is lost after the drying process.

BRIEF SUMMARY OF THE INVENTION

It is thus the object of the present invention to provide a dishwasher which can be used to efficiently clean and dry objects to be washed in a washing container and to keep the associated energy expenditure as low as possible.

The dishwasher according to the invention comprising a washing container has a conduit system connected in an air-conveying manner to the washing container into which both ends of at least one heat tube protrude, said heat tube being used for cooling and therefore for drying on the one hand and for heating air passed through from the washing container on the other hand.

As a result of using a heat tube, the objects to be treated only require substantially less heating compared with the prior art, e.g. in dishwashers in the "clear rinse" partial programme step. This means a substantial saving of energy. The cooling of the air lowers its moisture absorption capacity and the moisture fraction of the air is precipitated as condensate. As a result of the heating of the air, its moisture absorption capacity is increased again on each passage through the conduit system which leads to an improvement in the drying result and/or shortening of the drying time. In the closed air system any exchange of contaminated air from the surroundings is completely eliminated, preventing any back contamination of the items to be treated. The present invention provides a dishwasher which can be used to efficiently clean and dry objects to be washed in a washing container and to keep the associated energy expenditure as low as possible.

According to a preferred feature of the invention, in the at least one "drying" partial programme step air from the washing container is passed into the conduit system and back into the washing container, whereby the aforesaid advantages are used as prescribed in the dishwasher according to the invention.

In an especially advantageous fashion, the washing container has an outlet with a pipe to one end of the heat tube, a pipe from one end of the heat tube to the other end of the heat tube and an inlet with a pipe from the other end of the heat tube, a fan being arranged in the pipe to one end of the heat tube which supplies at least some of the air in the washing container to the conduit system at least temporarily. In the closed air system any exchange of contaminated air from the surroundings is completely eliminated, preventing any back contamination of the items to be treated. The fan can easily be controlled so that the use of the heat tube can be precisely and more simply controlled, for example, compared with the dishwasher described in DE 27 16 686 A1. In addition, the fan intensifies the action of the heat tube since the air being passed through is conveyed more rapidly.

According to another preferred feature of the invention, the air is cooled by means of the heat tube. The actual function of the heat tube, cooling whilst removing the absorbed thermal energy, is thus used. The cooling of the air reduces its moisture absorption capacity and the moisture fraction of the air is precipitated as condensate.

According to another preferred feature of the invention, the air is heated by means of the heat tube. The further function of the otherwise present heat tube, the transported heat absorbed during cooling of the moist air and during condensation of the moisture from the air, is used for further energy saving.

According to an advantageous embodiment of the invention, a heater is arranged in the conduit between the inlet and the other end of the heat tube. Should the heating of the air by the heat tube not be sufficient, the air is additionally heated by a heater to ensure the drying function. Despite the additional energy consumption for the heating, a saving of energy is achieved compared with the prior art described previously.

According to another advantageous embodiment of the invention, a condenser is arranged in the pipe between the outlet and one end of the heat tube or alternatively in the pipe between one end of the heat tube and the other end of the heat tube. Should the withdrawal of moisture from the air by the heat tube not be sufficient, the air is additionally passed by a condenser which undertakes the lacking removal of moisture to ensure the drying function.

BRIEF DESCRIPTION OF THE DRAWINGS

The invention is explained in detail hereinafter with reference to exemplary embodiments of a dishwasher according to the invention shown in the drawings. In the figures.

DETAILED DESCRIPTION OF EXEMPLARY EMBODIMENTS OF THE PRESENT INVENTION

Figure 1:
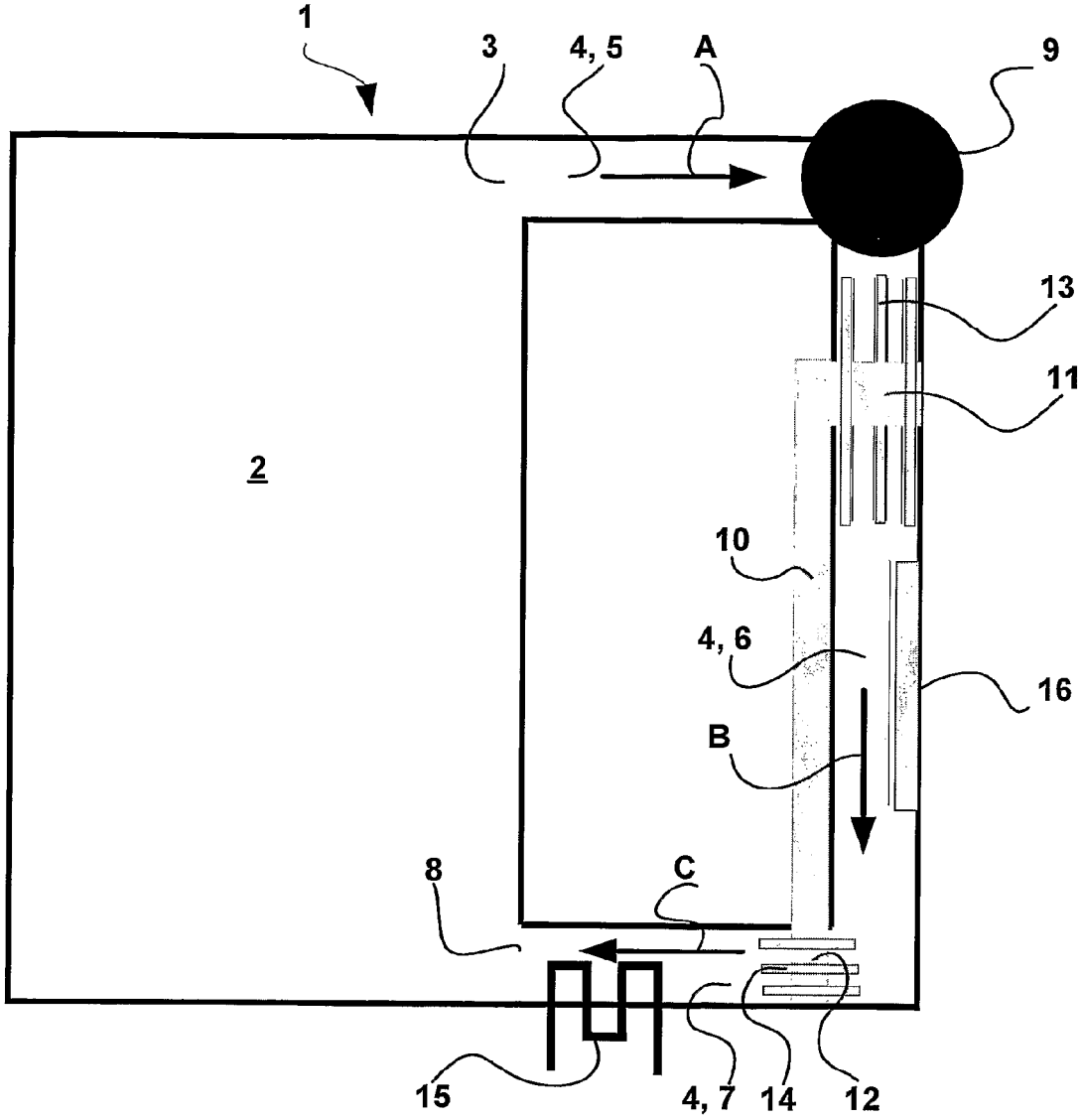
FIG. 1 is a schematic view of a dishwasher according to the invention with a perpendicularly arranged heat tube whose mode of action runs from top to bottom.

The figures show embodiments of the dishwasher 1, 1', 1", 1'" according to the invention comprising a washing container/basket 2, 2', 2", 2'" wherein crockery baskets not shown for placing items to be washed, which are not shown, are arranged. The same parts are labelled using the same reference numbers.

According to the invention, the dishwasher 1, 1', 1", 1'"comprises a conduit system 4, 4', 4", 4'" connected in an air-conveying manner to a washing container 2, 2', 2", 2'" wherein both ends 11, 11', 11", 11'", 12, 12', 12", 12'" of at least one heat tube 10, 10', 10", 10'" protrude, said heat tube 10, 10', 10", 10'" being used, as is described in detail further below, on the one hand for cooling and thereby drying and on the other hand for heating air passed through from the washing container 2, 2', 2", 2'".

The washing container 2, 2', 2", 2'" has an outlet 3, 3', 3", 3'" which leads to the conduit system 4, 4', 4", 4'" comprising a pipe 5, 5', 5", 5'" to one end 11, 11', 11", 11'" of the heat tube 10, 10', 10", 10'", comprising a pipe 6, 6', 6", 6'" from one end 11, 11', 11", 11' of the heat tube 10, 10', 10", 10'" to the other end 12, 12', 12", 12'" of the heat tube 10, 10', 10", 10'" and comprising a pipe 7, 7', 7", 7'" from the other end 12, 12', 12", 12'" of the heat tube 10, 10', 10", 10'" to an inlet 8, 8', 8", 8'" of the washing container 2, 2', 2", 2'", wherein located in the pipe 5, 5', 5", 5'" to one end 11, 11', 11", 11'" of the heat tube 10, 10', 10", 10'" is a fan 9, 9', 9", 9'" which supplies at least some of the air in the washing container 2, 2', 2", 2'" to the conduit system 4, 4', 4", 4'" at least temporarily.

In the closed air system any exchange of contaminated air from the surroundings is completely eliminated, preventing any back contamination of the items to be treated.

It is furthermore common to all the exemplary embodiments shown that a heater 15, 15', 15", 15'" is arranged in the pipe 7, 7', 7", 7'" from the other end 12, 12', 12", 12'" of the heat tube 10, 10', 10", 10'" to an inlet 8, 8', 8", 8'" of the washing container 2, 2', 2", 2'". Should the heating of the air by the heat tube 10, 10', 10", 10'" not be sufficient, the air is additionally heated by the heater 15, 15', 15", 15'" to ensure the drying function. Despite the additional energy consumption for the heater 15, 15', 15", 15'", a saving of energy is achieved compared with the prior art described previously.

It is furthermore common to all the exemplary embodiments shown that a condenser 16, 16', 16", 16'" is arranged in the pipe 6, 6', 6", 6'" from one end, the "cold side" 11, 11', 11", 11'" of the heat tube 10, 10', 10", 10'" to the other end, the "warm side" 12, 12', 12", 12'" of the heat tube 10, 10', 10", 10'". Alternatively it is also possible to have an arrangement of the condenser in the pipe to one end, to the "cold side" of the heat tube. Should the removal of moisture from the air by the heat tube 10, 10', 10", 10'" not be sufficient, the air is additionally passed to the condenser 16, 16', 16", 16'" which undertakes the lacking removal of moisture to ensure the drying function. The condenser 16, 16', 16", 16'" is in thermal contact with the surroundings.

FIG. 1 is a schematic diagram showing an embodiment of the dishwasher 1 according to the invention. This dishwasher 1 has a vertically arranged heat tube 10 whose mode of action runs from top to bottom. These heat tubes have an internal capillary structure which makes it possible for a filled working fluid not described in detail to rise from the "warm side" 12 to the "cold side" 11 of the heat tube 10. Thus the pipe 5 to the "cold side" 11 of the heat tube 10 is located in the upper area of the washing container 2.

Figure 2:
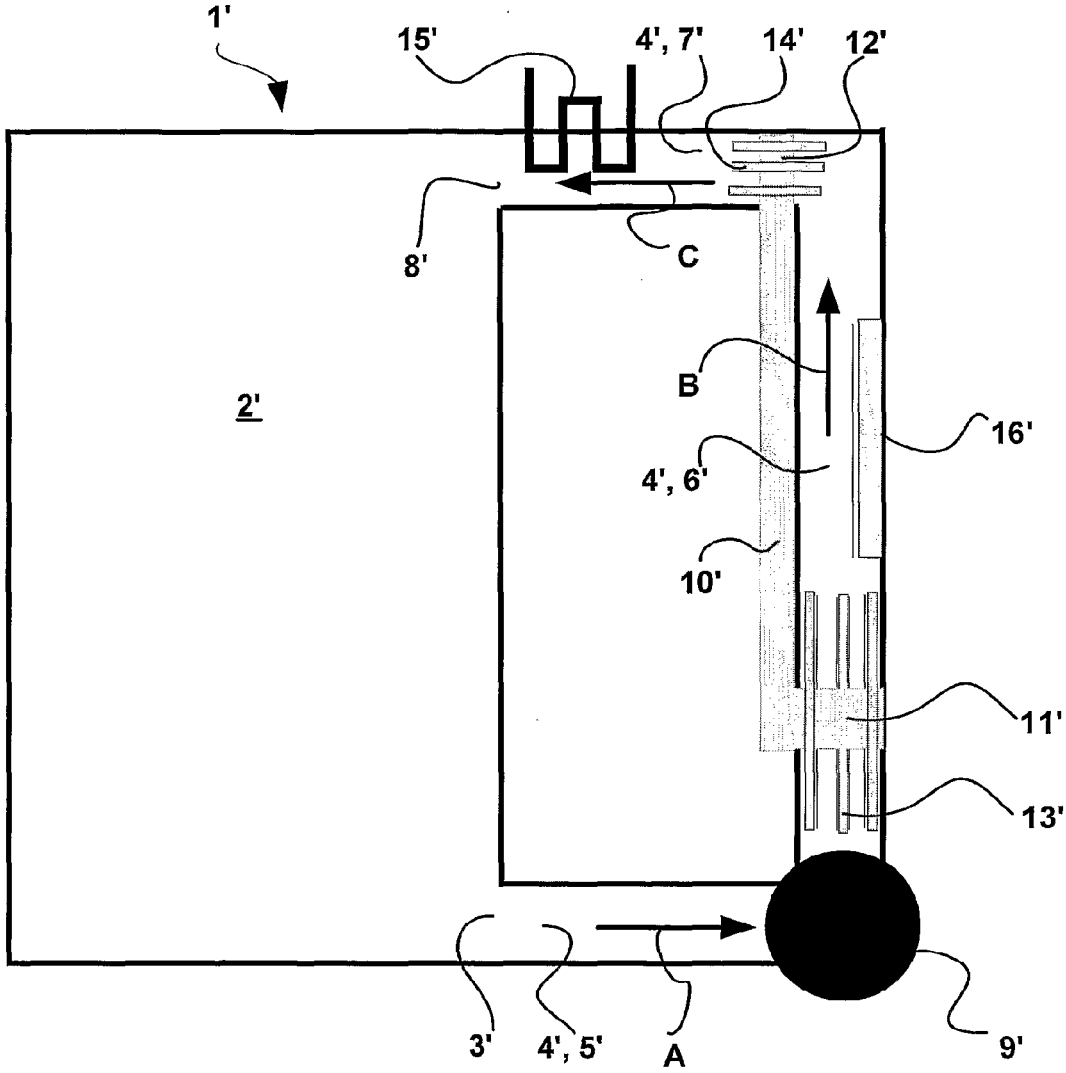
FIG. 2 is a schematic view of a dishwasher according to the invention with a perpendicularly arranged heat tube whose mode of action runs from bottom to top.

FIG. 2 is a schematic diagram showing another embodiment of the dishwasher 1' according to the invention. This dishwasher 1' has a vertically arranged heat tube 10' but its mode of action runs from bottom to top in contrast to the exemplary embodiments shown in FIG. 1. No heat tube 10' with capillaries is required since the working fluid drops from the "warm side" 12 to the "cold side" 11 of the heat tube 10 as a result of gravity.

Figure 3:
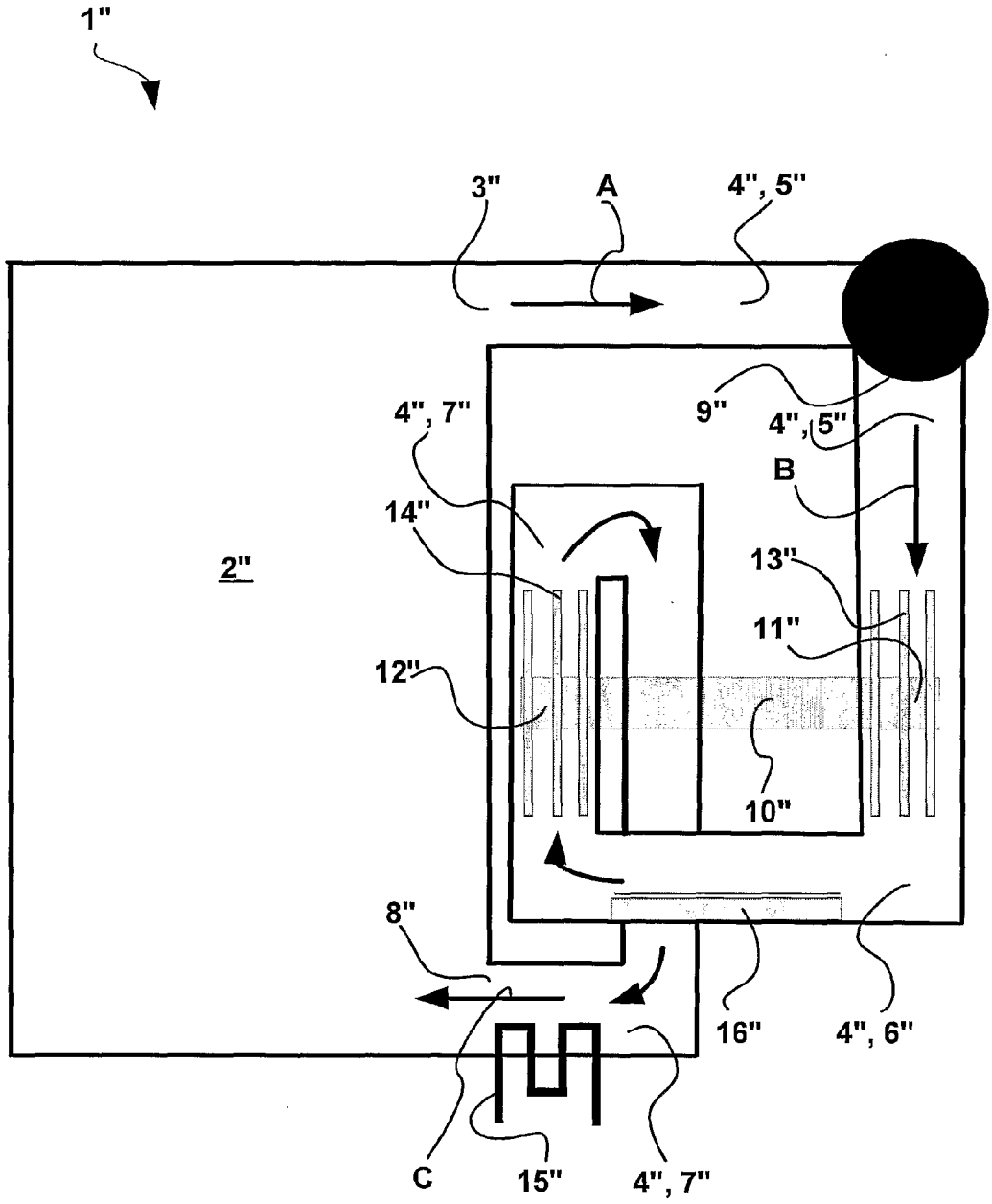
FIG. 3 is a schematic view of a dishwasher according to the invention with a horizontally arranged heat tube wherein the air is circulated from top to bottom.

FIG. 3 is a schematic diagram showing another embodiment of the dishwasher 1" according to the invention. In contrast to the two vertical heat tubes 10, 10' in FIGS. 1 and 2, the dishwasher 1" has a horizontally arranged heat tube 10". In this exemplary embodiment the air circulation runs from top to bottom. Thus the pipe 5" to the "cold side" of the heat tube 10" is located in the upper area of the washing container 2".

Figure 4:
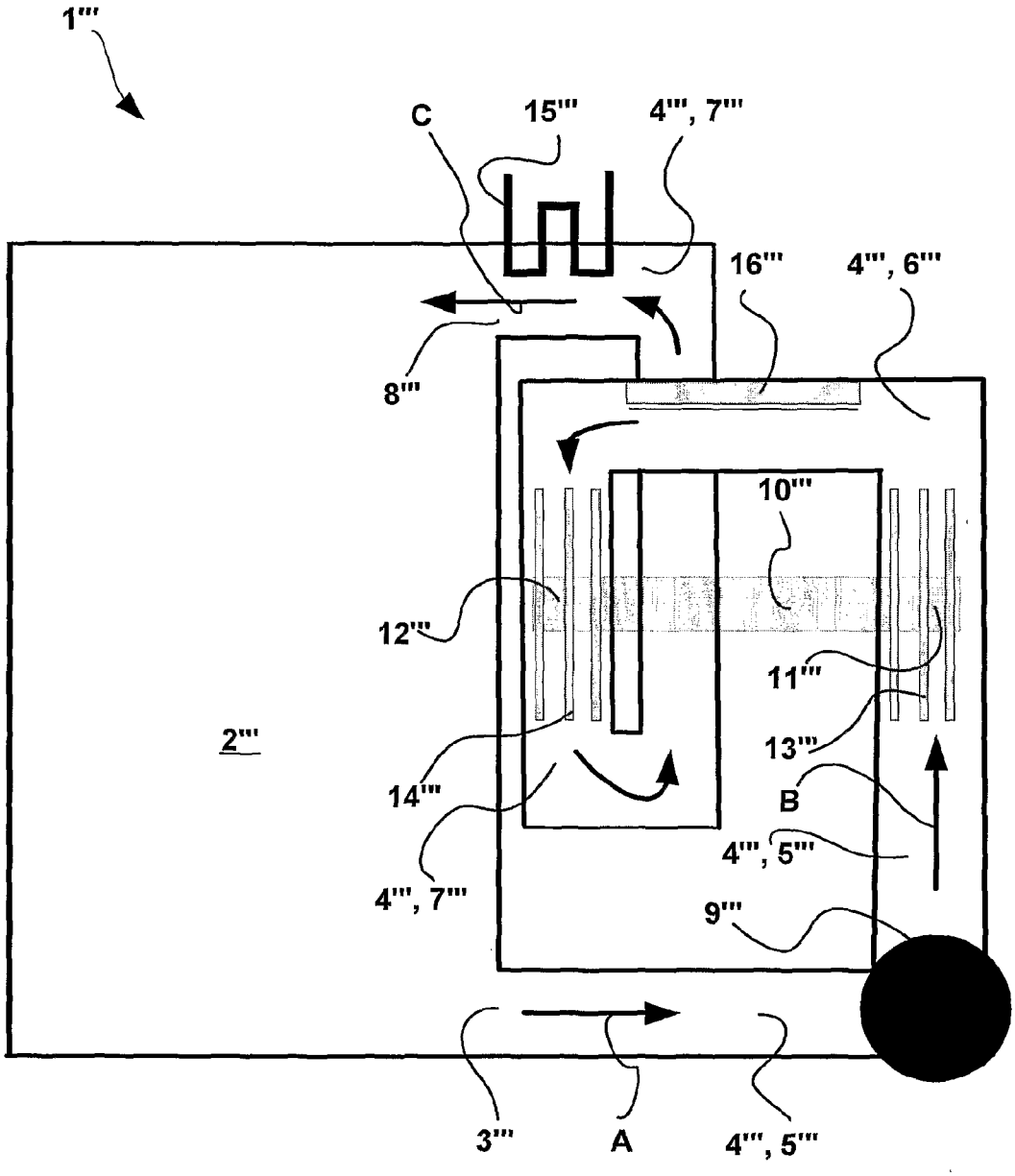
FIG. 4 is a schematic view of a dishwasher according to the invention with a horizontally arranged heat tube wherein the air is circulated from bottom to top.

FIG. 4 is a schematic diagram showing another embodiment of the dishwasher 1'" according to the invention. The dishwasher 1'" also has a horizontally arranged heat tube 10'" where the air circulation runs from bottom to top however. Thus the pipe 5" to the "cold side" of the heat tube 10" is located in the upper area of the washing container 2".

The method described hereinafter is basically the same in all the exemplary embodiments shown.

It is known that a dishwasher 1, 1', 1", 1'" has a washing method whose programme run consists of at least one partial programme step "pre-wash", a partial programme step "clean", at least one partial programme step "intermediate rinse", a partial programme step "clear rinse" and a partial program step "dry". According to the invention and in the exemplary embodiments explained, during the "dry" partial programme step air from the washing container 2, 2', 2", 2'" is passed through the conduit system 4, 4', 4", 4'" and back into the washing container 2, 2', 2", 2'". The fan 9, 9', 9", 9'" is switched on for this purpose. The air path is indicated by the arrows A, B and C. On the "cold side" 11, 11', 11", 11'" of the heat tube 10, 10', 10", 10'" a large amount of thermal energy is removed from the air passed by the fan 9, 9', 9", 9'" via the pipe 5, 5', 5", 5'" to one end 11, 11', 11", 11'", to the "cold side" of the heat tube 10, 10', 10", 10'" so that this is very severely cooled and since the cold air has a substantially lower moisture absorption capacity, a large fraction of the moisture condenses. Heat conducting fins 13, 13', 13", 13'" are provided for good heat conduction of the air to the heat tube 10, 10', 10", 10'". The heat tube 10, 10', 10", 10'" passes the heat removed from the moist air (sensible heat) and the heat produced by the condensation (latent heat) to its other end 12, 12', 12", 12'", the "warm side" of the heat tube 10, 10', 10", 10'". The now very dry air passes via the pipe 6, 6', 6", 6' from one end 11, 11', 11", 11'" of the heat tube 10, 10', 10", 10'" to the other end 12, 12', 12", 12'" of the heat tube 10, 10', 10", 10'" and is heated there. Heat conducting fins 14, 14', 14", 14'" are provided for good heat conduction from the heat tube 10, 10', 10", 10'" to the air. The now heated and very dry air is now passed via the pipe 7, 7', 7", 7'" from the other end 12, 12', 12", 12'" of the heat tube 10, 10', 10", 10'" to the inlet 8, 8', 8", 8'" of the washing container 2, 2', 2", 2'" and thus back into the washing container 2, 2', 2", 2'". The heated air introduced into the washing container 2, 2', 2", 2'" is now substantially drier and has a high absorption capacity for moisture. It rises upwards in the washing container 2, 2', 2", 2'" and absorbs the residual moisture on the objects to be washed. As has already been described above, it is now fed back to the heat tube 10, 10', 10", 10'".

As a result of using a hast tube 10, 10', 10", 10'", the items to be treated only require substantially less heating compared with the prior art, in the exemplary embodiments described only by about 50° C. or even less in the "clear rinse" partial programme step. This means a substantial saving of energy. As a result of heating the air, its moisture absorption capacity is increased again on each passage through the conduit system 4, 4', 4", 4'" which results in an improved drying result and/or shortening of the drying time.

The present invention provides a dishwasher 1, 1', 1", 1'" which can be used to efficiently clean and dry objects to be washed in a washing container 2, 2', 2", 2'" and to keep the associated energy expenditure as low as possible.

What is claimed is:

1. A dishwasher comprising:

a washing basket; and a conduit system connected to the washing basket in an air-guiding manner such that air is guided from the washing basket to the conduit system and air is guided from the conduit system to the washing basket and the conduit system including a cold side portion and a hot side portion and including at least one horizontally arranged heat tube having a pair of ends, one of the ends of the heat tube extending into the cold side portion of the conduit system and the other end of the heat tube extending into the hot side portion of the conduit system and the conduit system being operable to guide air in a spiral pattern through the conduit system in cooperation with the horizontally arranged heat tube from the washing basket through the cold side portion, wherein the spiral pattern of the conduit system is configured to guide the air perpendicularly across the heat tube at least twice between the cold side portion and the hot side portion, whereupon the one end of the heat tube promotes a cooling of air in the cold side portion of the conduit system with a resultant condensing of moisture out of the cooled air, to thereafter guide cooled air from the cold side portion to the hot side portion, whereupon the other end of the heat tube promotes heating of the air in the hot side portion of the conduit system, and to thereafter guide such heated air from the hot side portion to the washing basket and the heat tube operating to conduct heat from its one end extending into the cold portion of the conduit system to its other end extending into the hot portion of the conduit system with the one end of the heat tube receiving heat from air guided therepast at the cold side portion of the conduit system and conducting such received heat to its other end.

2. The dishwasher according to claim 1, wherein the conduit system is operable during at least one drying partial programme section of a washing program that is performed by the dishwasher to guide air from the washing basket into the conduit system and back into the washing basket.

3. The dishwasher according to claim 1, wherein the washing basket includes an outlet with a pipe communicated with the at least one heat tube, the at least one heat tube includes a pipe communicating one end thereof with the other end thereof, and the washing basket includes an inlet with a pipe communicated with the at least one heat tube and further comprising a fan arranged in the outlet with the pipe communicating the washing basket with the at least one heat tube, the fan being operable to supply at least some of the air in the washing basket to the conduit system at least temporarily.

4. The dishwasher according to claim 3 and further comprising a heater arranged in the pipe of the inlet of the washing basket communicated with the other end of the at least one heat tube.

5. The dishwasher according to claim 3 and further comprising a condenser arranged in the pipe of the outlet of the washing basket and the one end of the at least one heat tube.

6. The dishwasher according to claim 3 and further comprising a condenser arranged in the pipe between the one end of the at least one heat tube and the other end of the at least one heat tube.

7. The dishwasher according to claim 1, wherein air from the washing basket is cooled by the at least one heat tube.

8. The dishwasher according to claim 1, wherein air guided by the conduit system from the washing basket into the conduit system is heated by the at least one heat tube.

9. The dishwasher according to claim 1, wherein the heating and cooling of the air which is passed through the conduit system takes place at the same time.

10. The dishwasher according to claim 1, wherein the conduit system is configured such that air is guided from top to bottom in the dishwasher.

11. The dishwasher according to claim 1, wherein the conduit system is configured such that air is guided from bottom to top in the dishwasher.

12. A dishwasher comprising:

a washing basket; and a conduit system connected to the washing basket in a closed air system such that air is guided from the washing basket to the conduit system and air is guided from the conduit system to the washing basket without outside air input, the conduit system including a cold side portion and a hot side portion and including at least one horizontally arranged heat tube having a pair of ends, one of the ends of the heat tube extending into the cold side portion of the conduit system, and the other of the ends of the heat tube extending into the hot side portion of the conduit system, the conduit system being operable to guide air in a closed loop spiral pattern through the conduit system in cooperation with the horizontally arranged heat tube from the washing basket through the cold side portion, wherein the spiral pattern of the conduit system is configured to guide the air perpendicularly across the heat tube at least twice between the cold side portion and the hot side portion, whereupon the one end of the heat tube promotes a cooling of air in the cold side portion of the conduit system with a resultant condensing of moisture out of the cooled air, to thereafter guide cooled air from the cold side portion to the hot side portion, whereupon the other end of the heat tube promotes heating of the air in the hot side portion of the conduit system, and to thereafter guide such heated air from the hot side portion to the washing basket, the heat tube operating to conduct heat from its one end extending into the cold portion of the conduit system to its other end extending into the hot portion of the conduit system with the one end of the heat tube receiving heat from air guided therepast at the cold side portion of the conduit system and conducting such received heat to its other end.

13. The dishwasher according to claim 12, further comprising a heater arranged in the hot side portion of the conduit system.

14. The dishwasher according to claim 12 and further comprising a condenser arranged in the conduit system between the cold side portion and the hot side portion.

15. The dishwasher according to claim 12 and further comprising a condenser arranged between the one end of the at least one heat tube and the other end of the at least one heat tube.

16. The dishwasher according to claim 12, wherein the heating and cooling of the air which is passed through the conduit system takes place at the same time.

17. The dishwasher according to claim 12, wherein the conduit system is configured such that air is guided from top to bottom in the dishwasher.

18. The dishwasher according to claim 12, wherein the conduit system is configured such that air is guided from bottom to top in the dishwasher.

* * * * *